US007965855B1

(12) United States Patent
Ham

(10) Patent No.: US 7,965,855 B1
(45) Date of Patent: Jun. 21, 2011

(54) CONFORMABLE EAR TIP WITH SPOUT

(75) Inventor: Soohyun Ham, San Francisco, CA (US)

(73) Assignee: Plantronics, Inc., Santa Cruz, CA (US)

( * ) Notice: Subject to any disclaimer, the term of this patent is extended or adjusted under 35 U.S.C. 154(b) by 1437 days.

(21) Appl. No.: 11/392,861

(22) Filed: Mar. 29, 2006

(51) Int. Cl.
*H04R 25/00* (2006.01)

(52) U.S. Cl. ..... 381/380; 381/328; 181/130; 181/135

(58) Field of Classification Search ..... 381/328, 381/380; 181/130, 135
See application file for complete search history.

(56) References Cited

U.S. PATENT DOCUMENTS 2,513,985 A * 7/1950 Woodruff et al. ..... 381/372
4,443,668 A * 4/1984 Warren ..... 455/351
5,659,156 A * 8/1997 Mauney et al. ..... 181/130
6,688,421 B2 * 2/2004 Dyer et al. ..... 181/130
7,107,993 B2 * 9/2006 Magidson ..... 128/864
2006/0067556 A1 * 3/2006 Bailey et al. ..... 381/380
2006/0093176 A1 * 5/2006 McIntosh et al. ..... 381/328

OTHER PUBLICATIONS

Plantronics Inc., OmniSet User's Guide, Aug. 1988, USA.

* cited by examiner

*Primary Examiner* — Curtis Kuntz
*Assistant Examiner* — Ryan Robinson
(74) *Attorney, Agent, or Firm* — Intellectual Property Law Office of Thomas Chuang

(57) ABSTRACT

Apparatuses and methods for delivering sound to ear canal are provided. The apparatus generally includes a compressible and resilient toroidal section having an inner side and an outer side. An aperture extends from the outer side to the inner side and the outer side has a well disposed within an inner side surface about the aperture. The apparatus further includes a compressible and resilient spout integrated with the toroidal section and extending away from the inner side. The spout includes a channel disposed within an inner spout surface and the channel is coupled to the well.

34 Claims, 7 Drawing Sheets

CONFORMABLE EAR TIP WITH SPOUT

BACKGROUND OF THE INVENTION

Various audio products exist in which a receiver is placed in the user's ear. For example, "in-the-ear" headsets, also referred to as ear bud or concha style headsets are devices for transmitting received sounds to the ear of the user by means of a small receiver which is sized to fit in the lower concha in front of the ear canal. In telecommunication headsets, a voice tube is often coupled to the receiver and extends down and towards the user's mouth for receiving the user's voice and transmitting it over a telecommunications line. Conventional earbud concha style headsets position the receiver inside the lower concha between the tragus and anti-tragus to establish placement and support on the ear.

However, most audio products that are intended to be worn on the ear tend to be unstable when worn. Different ear shapes and sizes make it difficult for a single design to both fit the ear correctly and to stabilize the headset. Minor size and shape variations of the concha of individual users results in instability for users whose concha do not hold the headset with sufficient force or discomfort to those with smaller concha. Accordingly, the receiver is typically designed for a minimally sized concha and then held in place by mechanical stabilizer devices which fit around the outside of the ear, or around the head.

Mechanical stabilizer devices add complexity, which decreases ease of use and increases the cost of manufacturing. Some mechanical stabilizers can be difficult to operate or wear on the ear correctly due to an unintuitive or poor design, and require manual adjustment to position the receiver. Mechanical stabilizers also increase the size and weight of the headset, resulting in increased fatigue from prolonged use. Such mechanical stabilizers include, for example, ear hooks or headbands which arch over the top of the head from ear to ear.

Furthermore, such mechanical stabilizers may not properly position the receiver in the ear, thereby allowing audio to "leak" out from the user ear. This results in poor listening sound quality. The mechanical stabilizer may not ensure that the receiver stays in front of the ear canal, requiring the user to periodically readjust the stabilizer or receiver during usage to correct the placement.

As a result, there is a need for improved methods and apparatuses for wearing audio products.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Methods and apparatuses for headset ear tips are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Generally, this description describes a method and apparatus for an ear tip (also referred to herein as an "earbud") for use with an audio device such as a headset. The ear tip is conformable to the user's outer ear when inserted, and provides an acoustic seal when inserted. The ear tip is self adjusting, and can be fitted to various ear cavum sizes for comfortable wearing and a secure fit. The ear tip provides excellent audio quality as a result of the acoustic seal and a spout provided for direct sound porting and stability. The present invention is applicable to a variety of different types of mobile communication devices in addition to communication headsets, including stereo listening headsets and any other devices designed to deliver sound to the ear canal. While the present invention is not necessarily limited to such devices, various aspects of the invention may be appreciated through a discussion of various examples using this context.

According to an example embodiment of the present invention, an apparatus for delivering sound to ear canal is provided. The apparatus includes a compressible and resilient toroidal section having an inner side and an outer side. An aperture extends from the outer side to the inner side and the outer side has a well disposed within an inner side surface about the aperture. The apparatus further includes a compressible and resilient spout integrated with the toroidal section and extending away from the inner side. The spout includes a channel disposed within an inner spout surface and the channel is coupled to the well.

In a further example, the apparatus includes a toroidal section having an inner side and an outer side for resting within and conforming to a user concha. An aperture extends from the outer side to the inner side and the outer side. A spout is integrated with the toroidal section and extends away from the inner side for resting beneath a user tragus. The spout includes a channel disposed within an inner spout surface.

Figure 1A:
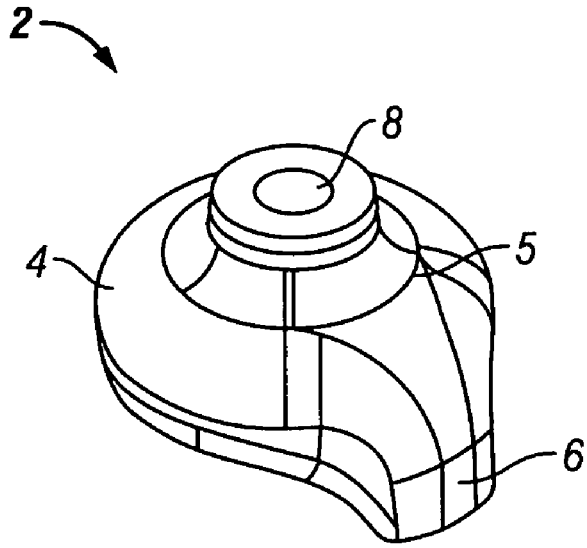
FIG. 1A illustrates a perspective view of an outer side of an ear tip in an example of the invention.
Figure 1B:
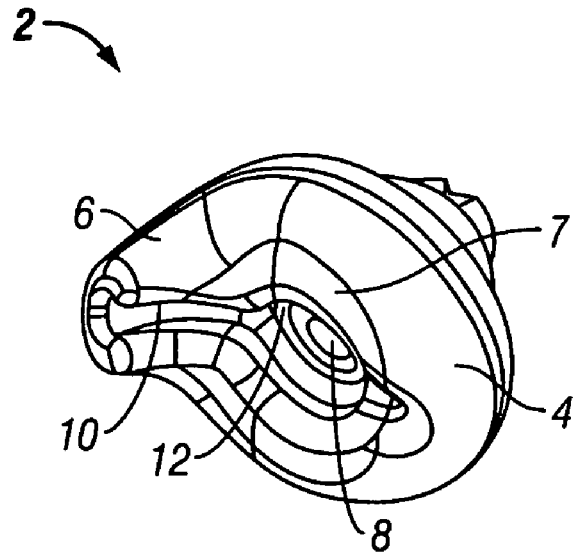
FIG. 1B illustrates a perspective view of an inner side of an ear tip in example of the invention.
Figure 2A:
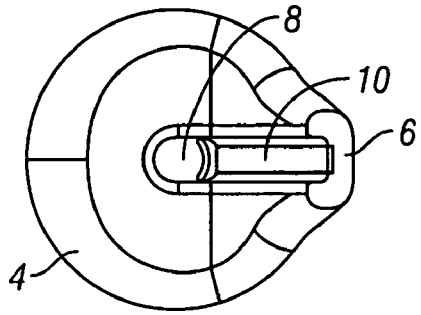
FIG. 2A illustrates a top view of the inner side of an ear tip in an example of the invention.
Figure 2B:
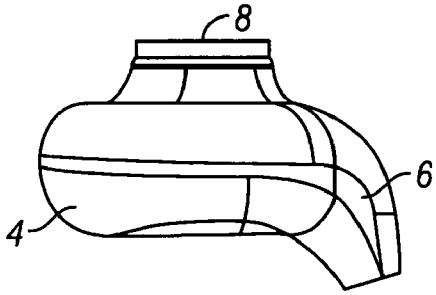
FIG. 2B illustrates a side view of an ear tip in an example of the invention.
Figure 2C:
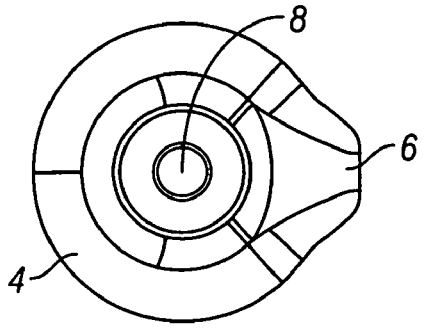
FIG. 2C illustrates a top view of the outer side of an ear tip in an example of the invention.

FIG. 1A illustrates a perspective view of an outer side 5 of an ear tip 2 in an example of the invention. FIG. 1B illustrates a perspective view of the inner side 7 of ear tip 2. FIGS. 2A, 2B, and 2C respectively illustrate a top view of the inner side 7 of ear tip 2, a side view of ear tip 2, and a top view of the outside 5 of ear tip 2.

Figure 3A:
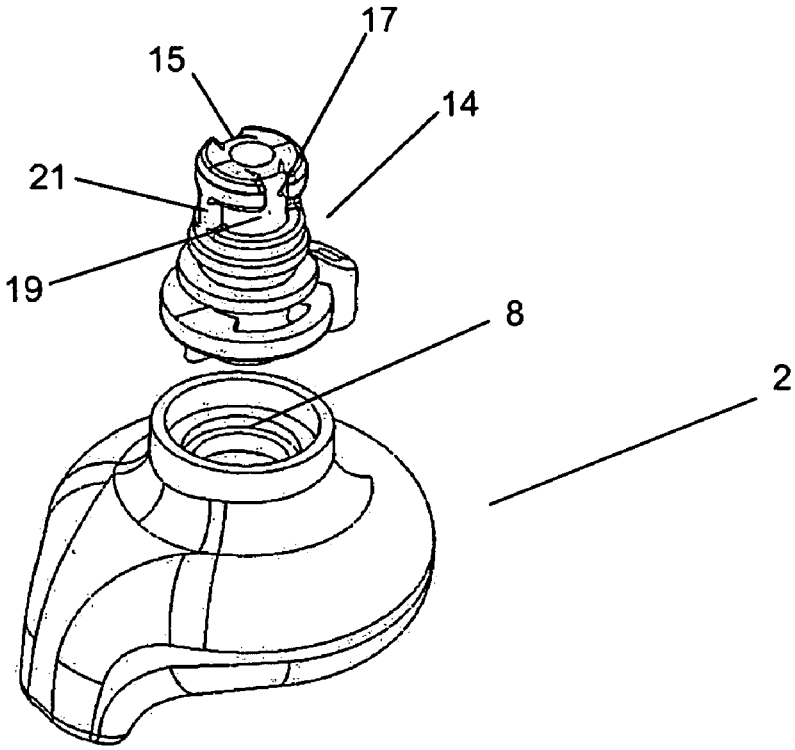
FIG. 3A illustrates a perspective view of a connector and an ear tip in an example of the invention.
Figure 3B:
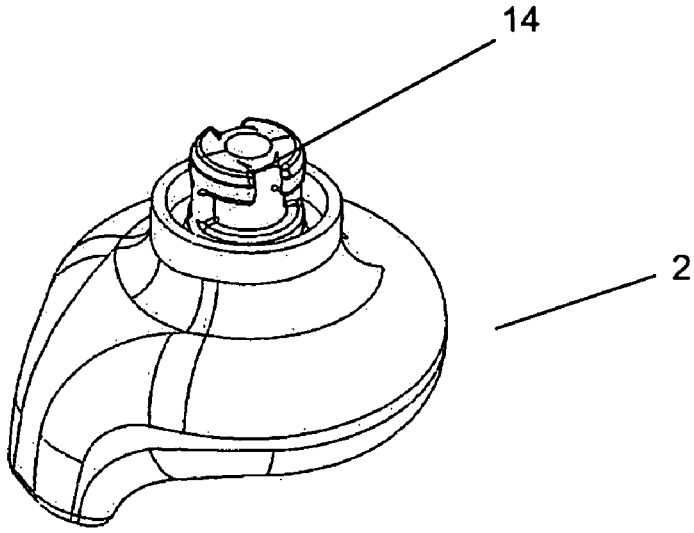
FIG. 3B illustrates a perspective view of the connector shown in FIG. 3A joined with the ear tip.

Referring to FIGS. 1A-1B and FIGS. 2A-2C, the ear tip 2 of the present invention is shown in a non-compressed state. Ear tip 2 is composed of two major sections, a toroidal section 4 and a spout section 6. Toroidal section 4 includes an aperture 8 serving as a port from the outer side 5 of ear tip 2 to the inner side 7 of ear tip 2. Referring to FIGS. 3A and 3B, aperture 8 may be adapted to receive a connector 14 during assembly for mating with an associated connector at a headset receiver in one example of the invention. In a further example of the invention, aperture 8 of ear tip 2 may mate directly with a headset receiver.

Referring to FIG. 1B, a well 12 is disposed on the inner side 7 of ear tip 2 about aperture 8. Spout section 6 is integrated with toroidal section 4 and extends away from the inner side 7 of ear tip 2. Spout section 6 includes a channel 10 disposed within an inner side spout surface and wherein the channel 10 is coupled to the well 12. Spout section 6 operates in part as a port for audio to be delivered to the user's ear canal. In one example, the spout section 6 extends a distance below the inner side defined plane of toroidal section 4 approximately 1 to 2 mm.

The spout section 6 is integrated into the toroidal section 4 that is overmolded onto an interlocking hard plastic connector which can be attached to an audio device receiver for either left or right ear wearing. When the ear tip 2 is locked onto the audio device receiver, the direction of the spout-like port is aligned with ear canal while the transmit port of the audio device is aligned with the corner of a mouth for optimal transmit and receive audio quality.

Figure 6:
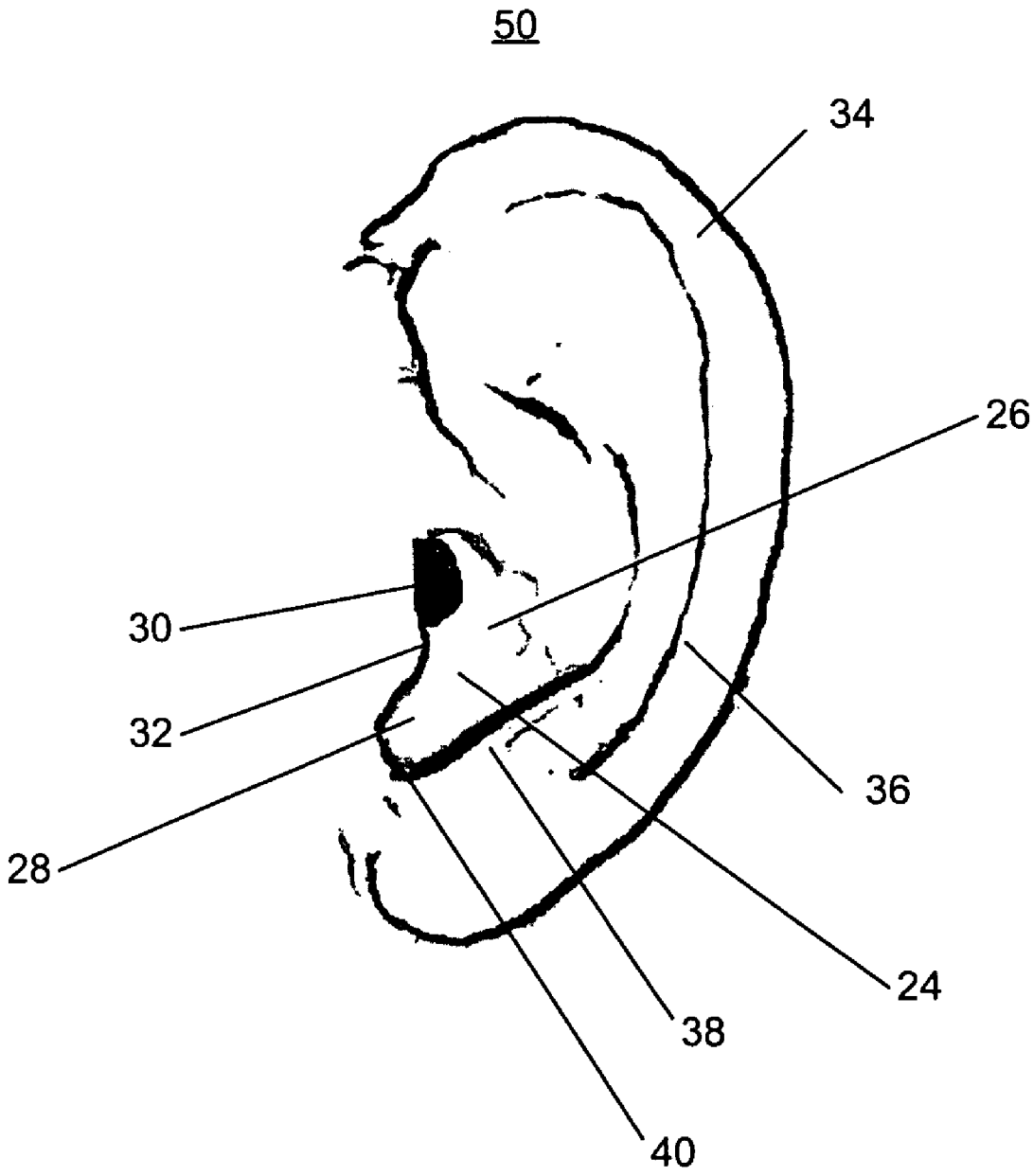
FIG. 6 illustrates a human ear.

Referring to FIG. 1B and FIG. 6, channel 10 defines an outlet port for direct porting of audio to the ear canal 30 when ear tip 2 is inserted into a user ear. In certain instances, the presence of channel 10 may prevent occlusion of aperture 8 and well 12 upon compression of spout section 6 upon insertion of ear tip 2. The presence of well 12 assists in porting sound from aperture 8 to channel 10 and may prevent occlusion of aperture 8 upon compression of toroidal section 4. In one example of the invention, for a toroidal section 4 having a diameter of 16 mm (corresponding to a "medium" size), channel 10 has a width of approximately 2 to 3 mm and preferably 2.5 mm and a depth of approximately 2 to 3 mm and preferably 2.8 mm. In a further example, the width of channel 10 may correspond to the diameter of aperture 8. In one example, well 12 has a diameter of approximately 3 to 4 mm and preferably 3.5 mm.

Figure 4A:
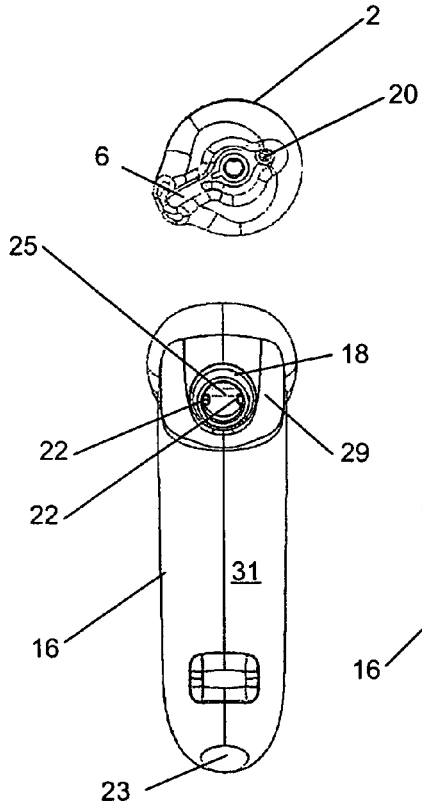
FIG. 4A illustrates a top view of an inner side of a headset and an ear tip.
Figure 7:
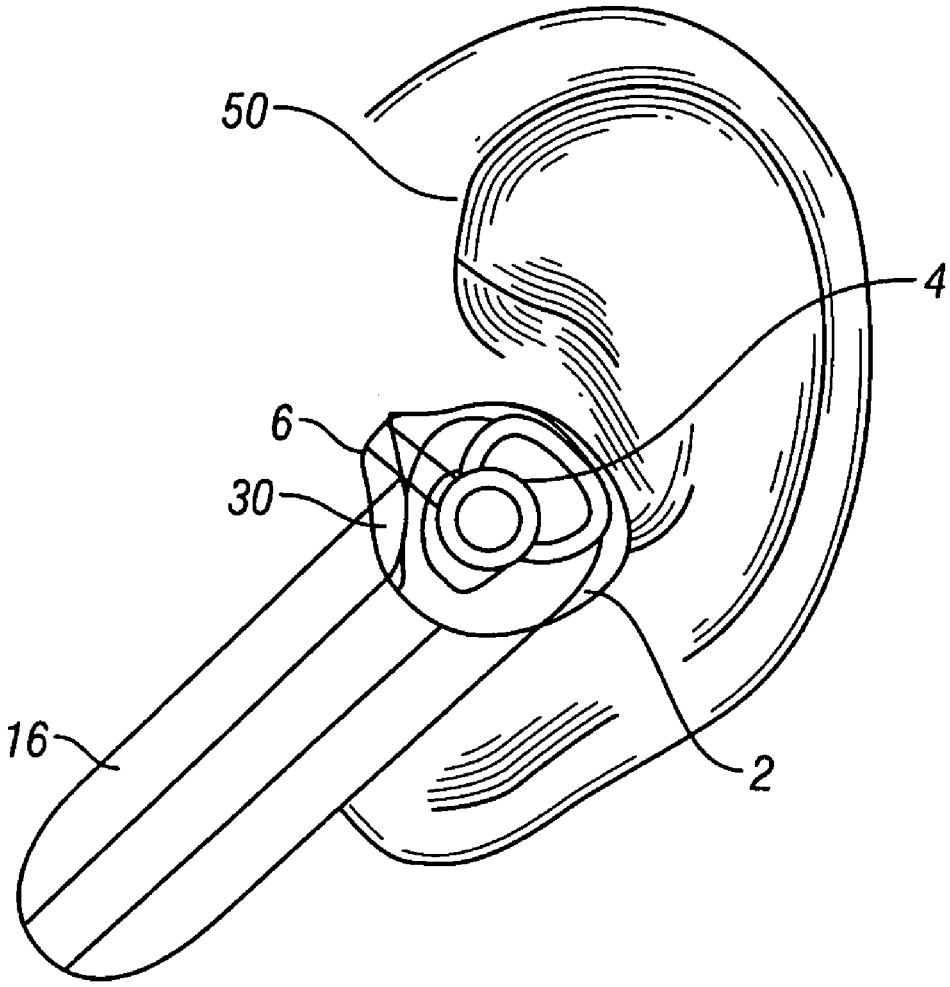
FIG. 7 illustrates an ear tip of the present invention inserted within a human ear.

Referring to FIG. 4A, the design of the spout section 6 directs audio such that good acoustical coupling between a headset receiver 29 and the user ear is achieved. Sound is delivered to the ear canal 30 directly. The orientation of spout section 6 when inserted further serves to position the headset 16 such that a boom microphone port 23 is automatically optimally positioned with respect to the user mouth, thereby ensuring good audio coupling between the boom microphone and sound emanating from the user's mouth. As shown in FIG. 7, a spout section 6 placed beneath the tragus 32 prevents toroidal section 4 from rotating within the user concha or being easily dislodged and falling out of the concha, greatly enhancing stability in the ear 50 and reducing the possibility that the weight of the headset may dislodge the ear tip, particularly during movement.

The compressibility of the toroidal section 4 accommodates variations in concha and ear size and ensures adequate holding pressure within the concha after placement in the user ear. The ear tip 2 is interchangeable with other ear tips of varying sizes to accommodate individual variations in user concha and ear size as well as user preference. For example, ear tip 2 may come in small, medium, and large sizes ranging in diameter from approximately 12-20 mm and height from 11 to 13 mm.

Referring again to FIG. 1B and FIG. 6, in operation, upon insertion of ear tip 2 into the user ear the spout section 6 is inserted beneath the tragus 32 and faces toward the ear canal 30. The lower concha 28 and intertragal notch 40 define a wedge-shaped space with an apex pointing generally toward the chin. To provide improved stability and direct porting of sound into the ear canal 30, spout section 6 slides beneath the tragus 32 while the toroidal section 4 rests within the lower concha 28 of the ear 50.

The spout section 6 compresses in an inward direction as the outer side 5 of ear tip 2 contacts and is pressed against the entrance of the ear canal 30 as the user then pushes the toroidal section 4 into the lower concha 28. Since the lower concha 28 and intertragal notch 40 define a wedge-shaped space, the toroidal shaped toroidal section 4 must compress as it is placed within the wedge shaped space. Toroidal section 4 does not penetrate the ear canal 30. Because the shape of the lower concha 28 is neither circular nor symmetrical from left to right ears, a toroidal shape in very soft, resilient and malleable material is advantageously selected for personalized custom fit and long term wearing comfort, allowing the ear tip to deform and adapt to the shape of the lower concha, and thereby maintain the receiver firmly in position.

Upon release, the toroidal section 4 expands to fill the lower concha 28, conforming to the individual user's lower concha 28 and forming an acoustic seal within the user ear. The tight fit of the toroidal section 4 within the ear creates excellent acoustic sealing that excludes ambient noise and provides superior sound quality and also reduces echo between receiver and microphone. Simultaneously, the spout section 6 may decompress slightly in a direction against the ear canal entrance beneath the tragus 32 and in alignment with the ear canal 30 to assist in sealing ear tip 2 within the user ear. As described earlier, channel 10 of spout section 6 prevents occlusion of aperture 8 when spout section 6 is in a compressed state when inserted. The spout section 6 is fitted in the entrance of ear canal for direct sound porting through the aperture 8 and also creates "undercut or hook" like contact in the ear which provides additional stability to the headset and allows for an increased weight headset. FIG. 7 illustrates an ear tip 2 of the present invention inserted within a human ear.

To achieve the compression characteristics of the ear tip 2 herein described, the toroidal section 4 and spout 6 are composed of a soft, elastic or elastomeric material. In one example, the material selected is non-porous. For example, ear tip 2 may be constructed from a compressible, conformable, and resilient material. Suitable materials include elastomers, foam, and air-filled injection molded materials. The elastomer may be sponge-like, filled with air pockets to enhance compressibility. The toroidal section 4 may also be hollow in a further example of the invention. Ear tip 2 may be fabricated by a variety of conventional methods including casting, compression molding, and injection molding.

In one example, an elastomer material such as rubber is used with a hardness of approximately between 10 and 20 durometers, and preferably about 15 durometers. In further example where other suitable materials are used, the materials are fabricated with an equivalent hardness. With such a hardness, the toroidal section 4 and spout 6 are relatively soft and highly compressible and may be easily inserted into the user ear and form a seal within the ear when released. In comparison to less compressible materials, the use of a higher compressibility material allows a larger sized ear tip 2 to be inserted, thereby providing a better fit and seal. In this example, the presence of well 12 assists to prevent occlusion of aperture 8 when ear tip 2 is in a highly compressed state.

FIG. 3A illustrates a perspective view of a connector 14 for use with an ear tip 2 in an example of the invention. FIG. 3B illustrates a perspective view of the connector 14 shown in FIG. 3A assembled within ear tip 2. Connector 14 is constructed from a rigid plastic material to which ear tip 2 is overmolded. In one mode of operation, connector 14 is designed to interlock with an associated connector at the headset receiver for either left or right ear wearing. Connector 14 includes a groove 15 and groove 17 leading to slot 19. Slot 19 wraps around the circumference of connector 14 and includes a stop 21.

Figure 4B:
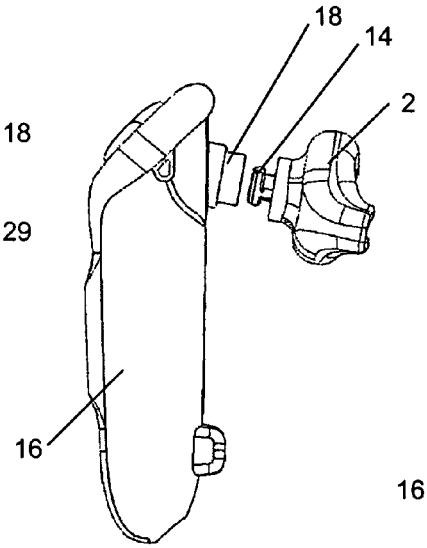
FIG. 4B illustrates a side view of the headset and ear tip shown in FIG. 4A.

FIG. 4A illustrates a side view of an inner side 31 of a headset 16 having a connector 18 for interlocking with connector 14. FIG. 4B illustrates a side view of the headset 16 and ear tip 2 prior to mating. Connector 18 includes a port 25 for receiving sound from the headset receiver 29. Disposed within the aperture are tabs 22. In operation, connector 14 and connector 18 are mated by aligning tabs 22 and grooves 15, 17 and pressing connector 14 onto connector 18 such that tabs 22 pass through grooves 15, 17 to slot 19. The connector 14 is then rotated either clockwise or counterclockwise until stop 21 abuts tabs 22 to lock connector 14 and connector 18 in either a right or left ear use position. In a further example of ear tip 2, shown in FIG. 4A, ear tip 2 may include an aperture 20 extending from the outer side 5 to the inner side 7 of ear tip 2 serving as a safety port from the user ear canal to the outside ambient air.

Figure 4C:
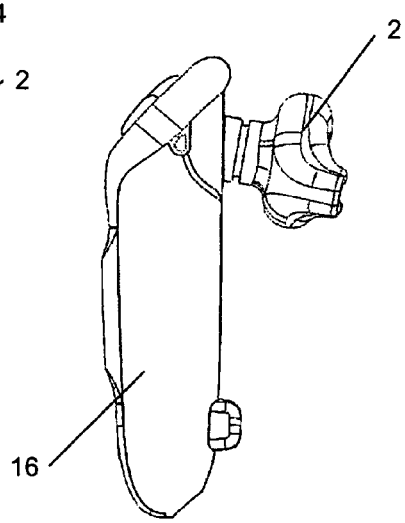
FIG. 4C illustrates a side view of the headset and ear tip shown in FIG. 4A in a mated position.
Figure 5A:
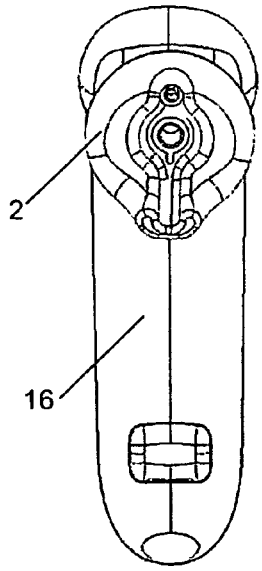
FIG. 5A illustrates a top view of an inner side of a headset and an ear tip in an unlocked position during mating and unmating.
Figure 5B:
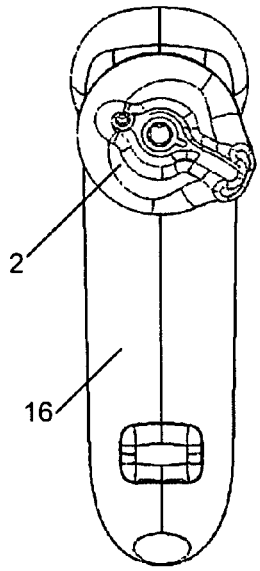
FIG. 5B illustrates a top view of an inner side of a headset and an ear tip in a locked mated position for left ear use.
Figure 5C:
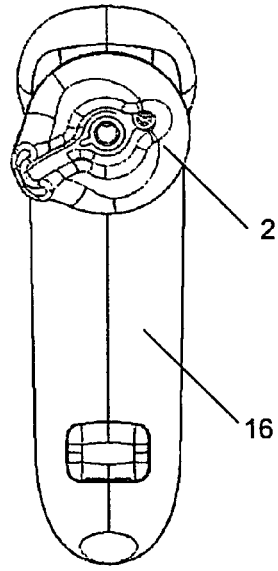
FIG. 5C illustrates a top view of an inner side of a headset and an ear tip in a locked mated position for right ear use.

FIG. 5A illustrates a top view of an inner side 31 of a headset 16 and an ear tip 2 in an unlocked position during mating and unmating in which tabs 22 and grooves 15, 17 (FIG. 3A) are aligned. FIG. 5B illustrates a top view of an inner side 31 of a headset and an ear tip in a locked mated position for left ear use following rotation of the connector 14 in a counter-clockwise direction. FIG. 5C illustrates a top view of an inner side 31 of a headset and an ear tip in a locked mated position for right ear use following rotation of the connector 14 in a clockwise direction. FIG. 4C illustrates a side view of the headset and ear tip in a mated position. The left/right orientation of the spout section 6 of the ear tip 2 with respect to the headset body is reversed for the left and right ears. The ear tip 2, in addition to providing an acoustic seal to deliver audio also secures and stabilizes the headset body.

FIG. 6 illustrates a typical human ear 50. The outer ear, or pinna, is an irregularly concave cartilaginous member comprised of a number of eminences and depressions which give each ear a distinct shape and form. The helix 34 is the curved outer rim of the ear; below the helix 34 is the anti-helix 36, a curved prominence which describes a curve around the concha cavum 24, a deep cavity containing the entry to the ear canal 30. The concha cavum 24 is divided into two parts, the upper concha 26 and lower concha 28, by the crux of the helix 34 which curves around the outside of the ear, and extends inwards at about the vertical midpoint of the ear. The upper concha 26 lies above the crux of the helix 34 and below the anti-helix 36; the lower concha 28 lies below the crux of the helix 34 and surrounds the entry to the ear canal 30. In front of the lower concha 28 and projecting backwards from the front of the ear is the tragus 32, a small semicircular prominence. Opposite the tragus 32 and separated from it by the deep curvature of the intertragal notch 40 is the antitragus 38.

The various examples described above are provided by way of illustration only and should not be construed to limit the invention. The invention can be used with any concha style headset receiver coupled to any audio source. The ear tip can be used with any headset for personal listening to any audio source device. For example, the invention can be used with headsets typically employed for listening to music. Although use of a toroidal shaped section is described, other similar shapes such as discs, "tire" shaped sections, or other flattened spherical shapes are considered equivalent.

Based on the above discussion and illustrations, those skilled in the art will readily recognize that various modifications and changes may be made to the present invention without strictly following the exemplary embodiments and applications illustrated and described herein. Such changes may include, but are not necessarily limited to: size of the ear tip and associated sections, material of the ear tip, and mating mechanism with an audio device receiver. Furthermore, the shapes and sizes of the illustrated headset housing and components may be altered. Such modifications and changes do not depart from the true spirit and scope of the present invention that is set forth in the following claims.

While the exemplary embodiments of the present invention are described and illustrated herein, it will be appreciated that they are merely illustrative and that modifications can be made to these embodiments without departing from the spirit and scope of the invention. Thus, the scope of the invention is intended to be defined only in terms of the following claims as may be amended, with each claim being expressly incorporated into this Description of Specific Embodiments as an embodiment of the invention.

What is claimed is:

1. An apparatus for delivering sound to an ear canal comprising:

a compressible toroidal section having an inner side and an outer side, wherein an aperture extends from the outer side to the inner side and the inner side has a well disposed within an inner side surface about the aperture; and a compressible spout integrated with the compressible toroidal section and extending away from the inner side, wherein the spout comprises a channel disposed within an inner spout surface and wherein the channel is coupled to the well.

2. The apparatus of claim 1, wherein the compressible toroidal section and compressible spout comprise an elastomer material, foam material, air-filled injection molded or cast material, or air filled elastomer material.

3. The apparatus of claim 1, wherein the compressible toroidal section and compressible spout comprise an elastomer material with a hardness of approximately 10 to 20 durometers.

4. The apparatus of claim 1, wherein the compressible toroidal section is hollow.

5. The apparatus of claim 1, wherein upon depression of an outer spout surface to a use position, the channel is aligned over the aperture.

6. The apparatus of claim 1, further comprising a connector with a first end and a second end, wherein the first end is disposed in the aperture at the outer side.

7. The apparatus of claim 6, wherein the connector comprises a plastic material.

8. The apparatus of claim 6, wherein the compressible toroidal section is overmolded to the first end.

9. The apparatus of claim 6, wherein the second end of the connector may be locked to a headset receiver in a first mated position for left ear use and a second mated position for right ear use.

10. The apparatus of claim 1, wherein the compressible toroidal section has a diameter of approximately 12 to 20 mm.

11. The apparatus of claim 1, wherein the compressible toroidal section has a height of approximately 11 to 13 mm.

12. The apparatus of claim 1, wherein the compressible toroidal section further comprises a porting aperture serving as a safety port from a user ear canal to an outside ambient air.

13. The apparatus of claim 1, wherein the aperture transmits sound received from a headset receiver.

14. The apparatus of claim 1, wherein the toroidal section has a diameter of approximately 16 mm and the well has a diameter of approximately 3 to 4 mm.

15. The apparatus of claim 1, wherein the toroidal section has a diameter of approximately 16 mm and the channel has a width of approximately 2 to 3 mm.

16. The apparatus of claim 1, wherein the toroidal section has a diameter of approximately 16 mm and the channel has a depth of approximately 2 to 3 mm.

17. An apparatus for delivering sound to an ear canal comprising:

a toroidal section having an inner side and an outer side for resting within and conforming to a user concha, wherein an aperture extends from the outer side to the inner side; and a spout integrated with the toroidal section and extending away from the inner side, wherein the spout comprises a channel disposed on an inner spout surface.

18. The apparatus of claim 17, wherein the toroidal section and spout comprise an elastomer material, foam material, air-filled injection molded or cast material, or air filled elastomer material.

19. The apparatus of claim 17, wherein the toroidal section and spout comprise an elastomer material with a hardness of approximately 10 to 20 durometers.

20. The apparatus of claim 17, wherein the toroidal section is hollow.

21. The apparatus of claim 17, wherein upon depression of an outer spout surface to a use position, the channel is aligned over the aperture.

22. The apparatus of claim 17, further comprising a connector with a first end and a second end, wherein the first end is disposed in the aperture at the outer side.

23. The apparatus of claim 22, wherein the connector comprises a plastic material.

24. The apparatus of claim 22, wherein the toroidal section is overmolded to the first end.

25. The apparatus of claim 22, wherein the second end of the connector may be locked to a headset receiver in a first mated position for left ear use and a second mated position for right ear use.

26. The apparatus of claim 17, wherein the toroidal section has a diameter of approximately 12 to 20 mm.

27. The apparatus of claim 17, wherein the toroidal section has a height of approximately 11 to 13 mm.

28. The apparatus of claim 17, wherein the toroidal section further comprises a porting aperture serving as a safety port from a user ear canal to an outside ambient air.

29. The apparatus of claim 17, wherein the aperture transmits sound received from a headset receiver.

30. The apparatus of claim 17, wherein the toroidal section has a diameter of approximately 16 mm and the channel has a width of approximately 2 to 3 mm.

31. The apparatus of claim 17, wherein the toroidal section has a diameter of approximately 16 mm and the channel has a depth of approximately 2 to 3 mm.

32. An apparatus for delivering sound to an ear canal comprising:

a toroidal means resting within and conforming to a user concha for delivering sound from a headset receiver to a user ear canal;

a spout means integrated with the toroidal means resting beneath a user tragus for securing the torodial means; and an exterior channel means disposed on a surface of the spout means.

33. The apparatus of claim 32, further comprising a connector means for coupling the toroidal means to a headset receiver.

34. The apparatus of claim 32, further comprising a safety porting means serving for porting between the user ear canal and an outside ambient air.

* * * * *